US010132004B2

(12) United States Patent
Lee et al.

(10) Patent No.: US 10,132,004 B2
(45) **Date of Patent: *Nov. 20, 2018**

(54) WATERPROOF SOUND-PERMITTING SHEET, METHOD OF MANUFACTURING SAME, AND ELECTRONIC DEVICE PROVIDED WITH WATERPROOF SOUND-PERMITTING SHEET

(71) Applicant: AMOGREENTECH CO., LTD., Gimpo-si (KR)

(72) Inventors: Seung Hoon Lee, Goyang-si (KR); Jun Sik Hwang, Incheon (KR); Yong Sik Jung, Namyangju-si (KR)

(73) Assignee: AMOGREENTECH CO., LTD., Gimpo-si (KR)

( * ) Notice: Subject to any disclaimer, the term of this patent is extended or adjusted under 35 U.S.C. 154(b) by 353 days.

This patent is subject to a terminal disclaimer.

(21) Appl. No.: 14/540,308

(22) Filed: Nov. 13, 2014

(65) Prior Publication Data

US 2015/0071472 A1 Mar. 12, 2015

Related U.S. Application Data

(63) Continuation-in-part of application No. PCT/KR2013/004062, filed on May 9, 2013.

(30) Foreign Application Priority Data

May 18, 2012 (KR) ..... 10-2012-0053143
May 7, 2013 (KR) ..... 10-2013-0051383

(51) Int. Cl.
*H04R 1/44* (2006.01)
*D01D 5/00* (2006.01)
(Continued)

(52) U.S. Cl.
CPC ..... *D01D 5/0007* (2013.01); *D01D 5/0084* (2013.01); *D01F 1/04* (2013.01); *H04R 1/023* (2013.01)

(58) Field of Classification Search
None
See application file for complete search history.

(56) References Cited

U.S. PATENT DOCUMENTS

2011/0143114 A1* 6/2011 Horie ..... B32B 5/32 428/219
2012/0040581 A1* 2/2012 Kim ..... C04B 35/62218 442/330
2013/0099411 A1 4/2013 Horie et al.

FOREIGN PATENT DOCUMENTS

JP 08232170 9/1996
KR 1020090128097 12/2009
(Continued)

OTHER PUBLICATIONS

International Search Report—PCT/KR2013/004062 dated Sep. 6, 2013.

*Primary Examiner* — Shawn McKinnon
(74) *Attorney, Agent, or Firm* — Cantor Colburn LLP

(57) ABSTRACT

Provided is a waterproof sound-permitting sheet, including: a porous substrate having a plurality of pores; and a porous nanoweb, which is stacked on the porous substrate, has a plurality of pores, and is formed by electrospinning a polymer material to which a black or a different color pigment is added, thereby improving waterproofing performance and sound penetration performance by forming on a porous substrate, such as non-woven fabric, the porous web having the black or the different color by using the electrospinning method, and can shorten a production process by eliminating a pigment coating step by means of adding the
(Continued)

pigment to the polymer material when manufacturing the porous nanoweb according to the electrospinning method.

7 Claims, 5 Drawing Sheets

(51) Int. Cl.
*H04R 1/02* (2006.01)
*D01F 1/04* (2006.01)

(56) References Cited

FOREIGN PATENT DOCUMENTS

| | | | |
|---|---|---|---|
| KR | 1020090128104 | | 12/2009 |
| KR | 1020100024119 | | 3/2010 |
| KR | 1020100041839 | | 4/2010 |
| WO | WO2011040752 | * | 4/2011 |

* cited by examiner

WATERPROOF SOUND-PERMITTING SHEET, METHOD OF MANUFACTURING SAME, AND ELECTRONIC DEVICE PROVIDED WITH WATERPROOF SOUND-PERMITTING SHEET

CROSS REFERENCE TO RELATED APPLICATIONS

This application is a continuation-in-part application of PCT Application No. PCT/KR2013/004062, filed on May 9, 2013, which claims priority to and the benefit of Korean Application Nos. 10-2012-0053143 filed on May 18, 2012 and 10-2013-0051383 filed on May 7, 2013, the entire contents of which are incorporated herein by reference.

TECHNICAL FIELD

The present invention relates to a technology that is provided for sound holes or air vents of a speaker or microphone of an electronic device so that sound and air is passed but water is blocked, and more particularly, to a waterproof sound-permitting sheet that is produced by an electrospinning method, a manufacturing method thereof, and an electronic device provided with the waterproof sound-permitting sheet.

BACKGROUND ART

Recently, since it is easy to carry and use portable electronic devices, the use of the portable electronic devices is increasing day by day. These portable electronic devices such as portable terminals, digital cameras, or notebook computers may be required to have a waterproof function due to they are carried and used with the portability. However, sound holes are formed to emit sound at a portion where a speaker or microphone is installed, and accordingly water and dust are penetrated into an electronic device through the sound holes.

Thus, a waterproof sound-permitting sheet is provided in the sound holes to pass the sound but to block water or dust. For water resistance of the waterproof sound-permitting sheet, it is advantageous to reduce an average diameter of fine holes, and for sound-permittivity of the waterproof sound-permitting sheet, it is advantageous to enlarge the size of the fine holes. Therefore, it is important to maintain the average diameter of the fine holes as appropriate so as to satisfy two conditions such as the sound-permittivity and the waterproof.

As disclosed in Korean Patent Application Publication No. 10-2010-0041839 (published on Apr. 22, 2010), a conventional waterproof sound-permitting film includes a polytetrafluoroethylene porous film, in which the polytetrafluoroethylene porous film includes: a first porous layer; and a second porous layer stacked on and integrated with the first porous layer based on a settlement force acting between a matrix of polytetrafluoroethylene, surface density of the waterproof sound-permitting film is 1 to 20 g/m2, the first porous layer and the second porous layer are biaxially oriented, and a draw ratio of the first porous layer is equal to that of the second porous layer.

Such a waterproof sound-permitting film is configured to have a double layer structure formed of the first porous layer and the second porous layer, to thereby improve the waterproof performance. However, since the conventional waterproof sound-permitting film is formed of only a polytetrafluoroethylene porous film, fine holes of the porous film will increase gradually in size due to the pressure of the shock or sound externally applied due to the long use, and thus there is a problem that waterproof performance is reduced.

SUMMARY OF THE INVENTION

To solve the above problems or defects, it is an object of the present invention to provide a waterproof sound-permitting sheet that is produced by an electrospinning method to thus have a plurality of pores in a nanoweb form, a manufacturing method thereof, and an electronic device provided with the waterproof sound-permitting sheet.

In addition, it is another object of the present invention to provide a waterproof sound-permitting sheet, a manufacturing method thereof, and an electronic device provided with the waterproof sound-permitting sheet, in which a pigment is added in a polymer material when a porous nanoweb is manufactured by an electrospinning method, to thereby delete an operation of coating the pigment, and to thus shorten a production process and improve waterproof performance and sound-permitting performance.

In addition, it is still another object of the present invention to provide a waterproof sound-permitting sheet, a manufacturing method thereof, and an electronic device provided with the waterproof sound-permitting sheet, in which a porous nanoweb is manufactured on a porous substrate by an electrospinning method, to thereby improve the sheet strength, and adjust the thickness of the nanoweb, the average diameter of the pores, and the number of pores, and to thus be applicable for various products.

The technical problems to be solved in the present invention are not limited to the above-mentioned technical problems, and the other technical problems that are not mentioned in the present invention may be apparently understood by one of ordinary skill in the art in the technical field to which the present invention belongs.

To accomplish the above and other objects of the present invention, according to an aspect of the present invention, there is provided a waterproof sound-permitting sheet comprising: a porous substrate having a plurality of pores; and a porous nanoweb, which is stacked on the porous substrate, has a plurality of pores, and is formed by electrospinning a polymer material to which a black or different color pigment is added.

According to another aspect of the present invention, there is provided a method of manufacturing a waterproof sound-permitting sheet, the method comprising: supplying a porous substrate having a plurality of pores; and spinning a spinning solution to the porous substrate, thereby forming a porous nanoweb having a plurality of pores and having a black or different color.

According to another aspect of the present invention, there is provided a method of manufacturing a waterproof sound-permitting sheet, the method comprising: supplying a porous substrate having a plurality of pores; spinning a spinning solution to one surface of the porous substrate, thereby forming a first nanoweb layer having a plurality of pores and having a black or different color; and spinning the spinning solution to the other surface of the porous substrate, thereby forming a second nanoweb layer having a plurality of pores and having the black or different color.

According to another aspect of the present invention, there is provided a method of manufacturing a waterproof sound-permitting sheet, the method comprising: supplying a first porous substrate having a plurality of pores; spinning a spinning solution to one surface of the first porous substrate, thereby forming a porous nanoweb having a plurality of pores and having a black or different color; and stacking a second porous substrate having a plurality of pores on the other surface of the porous nanoweb.

As described above, the waterproof sound-permitting sheet according to the present invention is configured by forming a porous nanoweb having a black or different color on a porous substrate such as a nonwoven fabric by a spinning method, thereby having advantages of improving strength of the waterproof sound-permitting sheet, and improving the waterproof performance and the sound-permitting performance.

In addition, the waterproof sound-permitting sheet according to the present invention is configured by forming a porous nanoweb by an electrospinning method, thereby having advantages of adjusting the thickness of the nanoweb, an average diameter of pores, and the number of pores and being applied to a wide range of products.

Further, the waterproof sound-permitting sheet according to the present invention is configured by adding a pigment to a polymer material when manufacturing a porous nanoweb on a nonwoven fabric by an electrospinning method, to thereby delete an operation of coating the pigment, to thus shorten a production process, and to improve the waterproof performance and the sound-permitting performance.

DETAILED DESCRIPTION OF THE INVENTION

Figure 1:
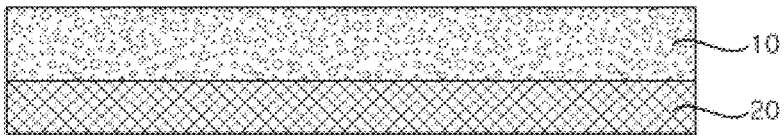
FIG. 1 is a cross-sectional view of a waterproof sound-permitting sheet according to a first embodiment of the present invention.

Embodiments of the present invention will be described below in detail with reference to the accompanying drawings. Here, the size or shape of the components illustrated in the drawings may be shown to be exaggerated for convenience and clarity of illustration. In addition, specifically defined terms may be changed according to the intention or practices of users or operators in consideration of the construction and operation of the present invention. The definition of the terms should be made based on contents throughout the present specification.

Figure 2:
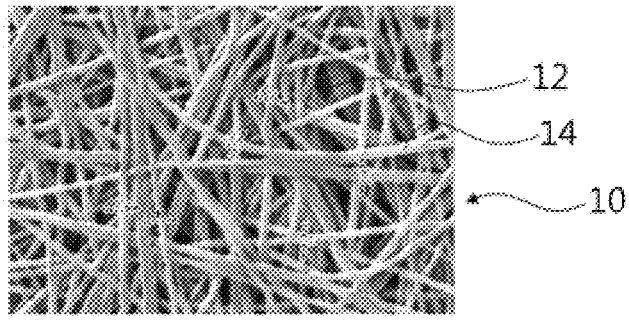
FIG. 2 is an enlarged close-up photograph of a waterproof sound-permitting sheet according to the first embodiment of the present invention.

As shown in FIGS. 1 and 2, a waterproof sound-permitting sheet according to a first embodiment of the present invention includes: a porous substrate 20 having a plurality of pores; and a porous nanoweb 10, which is stacked on one surface of the porous substrate 20, has a plurality of pores, and is formed by electrospinning a polymer material to which a black or different color pigment is added.

Any one of a thermal bond nonwoven fabric, a spun bond nonwoven fabric, a chemical bond nonwoven fabric, an air-laid nonwoven fabric, and a mixture thereof may be used as the porous substrate 20. Further, a cloth, styrofoam, paper, or a mesh that has pores may be used as the porous substrate 20, in addition to the nonwoven fabric.

The porous substrate 20 may have a black or different color, and a method of coating the pigment may employ gravure printing, coating, and may also employ a dope-dye scheme.

The porous nanoweb 10 is formed into a shape having a plurality of pores 12, by making ultra-fine fiber strands 14 by electrospinning the polymer material to which the black or different color pigment is added, and accumulating the ultra-fine fiber strands.

The polymer material used to make the porous nanoweb 10 in the present invention may be a resin that may be dissolved in an organic solvent for electrospinning, and that may be capable of forming nanofibers by electrospinning, but are not specifically limited thereto.

For example, the polymer materials used in the present invention may be: polyvinylidene fluoride (PVdF), poly (vinylidene fluoride-co-hexafluoropropylene), a perfluoropolymer, polyvinyl chloride, polyvinylidene chloride, or a copolymer thereof; a polyethylene glycol derivative containing polyethylene glycol dialkylether and polyethylene glycol dialkylester; poly(oxymethylene-oligo-oxyethylene); polyoxide containing polyethylene oxide and polypropylene oxide; polyvinyl acetate, poly(vinyl pyrrolidone-vinyl acetate), polystyrene, and a polystyrene acrylonitrile copolymer; a polyacrylonitrile copolymer containing polyacrylonitrile (PAN) and a polyacrylonitrile methyl methacrylate copolymer; or polymethyl methacrylate, a poly methyl methacrylate copolymer, or a mixture thereof.

Further, the polymer material used in the present invention may be: aromatic polyester such as polyamide, polyimide, polyamideimide, poly(meta-phenylene isophthal amide), polyester sulfone (PES), polyether ketone, polyetherimide (PEI), polyethylene terephthalate, polytrimethylene terephthalate, or polyethylene naphthalate; polyphosphazene such as polytetrafluoroethylene, polydifenoxiphosphazene, or poly{bis[2-(2-methoxyethoxy) phosphazene]}; polyurethane, and polyurethane copolymer containing polyether urethane; or cellulose acetate, cellulose acetate butyrate, or cellulose acetate propionate.

The polymer material that may be particularly desirably used to make a porous nanoweb according to the present invention may be polyacrylonitrile (PAN), polyvinylidene fluoride (PVdF), polyester sulfone (PES), and polystyrene (PS), alone or a mixture of polyvinylidene fluoride (PVdF) and polyacrylonitrile (PAN), a mixture of PVdF and PES, or a mixture of PVdF and thermoplastic polyurethane (TPU).

Thus, the polymer that may be used in the present embodiment is not particularly limited to thermoplastic and thermosetting polymers that may be air-electrospinnable.

The solvent that may be used in the present embodiment may be any one of DMAc (N, N-Dimethyl acetoamide), DMF (N, N-Dimethylformamide), NMP (N-methyl-2-pyrrolidinone), DMSO (dimethyl sulfoxide), THF (tetra-hydrofuran), EC (ethylene carbonate), DEC (diethyl carbonate), DMC (dimethyl carbonate), EMC (ethyl methyl carbonate), PC (propylene carbonate), water, acetic acid, formic acid, chloroform, dichloromethane, and acetone or a mixture thereof.

Since the porous nanoweb 10 is produced by an electrospinning method, the thickness of the porous nanoweb 10 is determined according to the dose of the electrospun polymer material. Thus, it is advantageously easy to make the thickness of the porous nanoweb 10 into a desired thickness. That is, if the dose of the electrospun polymer material is made less, the thickness of the porous nanoweb 10 may be made thin, and since the dose of the electrospun polymer material is little, the production cost can be reduced that much.

Here, it is determined that the porous nanoweb 10 has the number of pores and an average diameter of pores, depending on the thickness of the porous nanoweb 10. Accordingly, the thickness of the porous nanoweb 10 is made thicker in order to improve the waterproof performance, and the thickness of the porous nanoweb 10 is made thinner in order to improve the sound-permitting performance.

Thus, a variety of different types of waterproof sound-permitting sheets whose waterproof and sound-permitting features vary according to functions and types of electronic devices can be made.

The diameters of the fiber strands 14 are in the range of 0.3~1.5 μm. Then, the average pore size is up to 1.5~2 μm, and the minimum pore size is not limited. That is, the average pore size is preferably not more than 2 μm.

In addition, since the ultra-fine fiber strands 14 are formed in the case of the porous nanoweb 10, a myriad of irregular pores are formed, which is more effective in improving the waterproof performance and the sound-permitting performance at the same time.

The pigments are used to prepare the waterproof sound-permitting sheet of black or another color, in which a variety of colors or tones can be implemented in accordance with the amount and the type of the applied pigment.

In this embodiment, a pigment is added in the polymer material to then be electrospun. Accordingly, an operation of coating a pigment on the surface of the porous nanoweb can be removed, to thus provide an effect of reducing the manufacturing process, and to make the average diameter of pores precisely.

Gravure printing, coating, etc., may be used as the existing method of applying a pigment on the surface of the porous nanoweb. When a pigment is coated in this way to thus implement a color, problems such as degradation of the air permeability and low color fastness may occur. In this embodiment, a pigment is added in the polymer material to thus prepare nanowebs. Accordingly, the fastness of the color can be inherently improved, the waterproof performance, the sound-permitting performance, and the air-permitting performance can be improved, and air permeability can be prevented from being lowered.

Then, the waterproof sound-permitting sheet according to the present embodiment is oil-repellent finish treated on the surface thereof so as to further improve the waterproof performance. Here, the oil-repellent finish is formed by treating an organic fluorine compound on the surface of the porous nanoweb 10 or the surface of a porous substrate. Besides, in addition to the above oil-repellent finish treatment, various ways can be applied for the oil-repellent finish treatment.

Then, the waterproof sound-permitting sheet according to the present embodiment can be used a waterproof air-permitting sheet that passes heat or air but blocks water or dirt.

Figure 3:
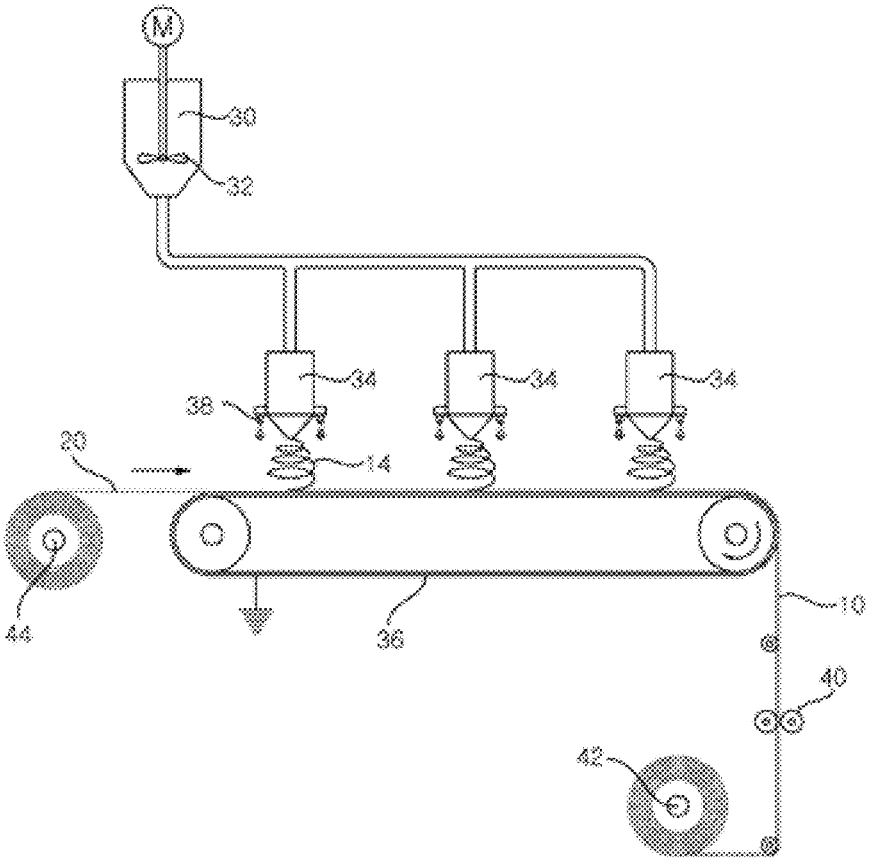
FIG. 3 is a configuration diagram of an electrospinning apparatus for producing a waterproof sound-permitting sheet according to the first embodiment of the present invention.

As shown in FIG. 3, an electrospinning apparatus for producing a waterproof sound-permitting sheet according to the first embodiment of the present invention includes: a spinning solution tank 30 that stores a spinning solution that is formed by mixing a polymer material to which s black or different color pigment is added with a solvent; a plurality of spinnerets 34 that are connected to a high voltage generator and connected to the spinning solution tank 30, to thus spin ultra-fine fiber strands 14; and a collector 36 on which the ultra-fine fiber strands 14 spun from the spinnerets 34 are accumulated to thereby produce a porous nanoweb 10.

The spinning solution tank 30 is provided with a stirrer 32 that mixes evenly the polymer material, the pigment, and the solvent, and that also prevents phase separation of the spinning solution 32.

A high voltage electrostatic force of 90~120 Kv is applied between the collector 36 and the spinnerets 34, and the ultra-fine fiber strands 14 are spun from the spinnerets 34. Accordingly, the porous nanoweb 10 is formed on the collector 36.

The plurality of the spinnerets 34 are arranged at intervals along the traveling direction of the collector 36, and also the plurality of the spinnerets 34 are arranged at intervals along a direction perpendicular to the traveling direction of the collector 36, i.e., along the width direction of the collector 36. FIG. 3 shows that there are three spinnerets for convenience of explanation, which are arranged at intervals along the traveling direction of the collector 36.

For example, 30 to 60 or more of the spinnerets may be arranged along the travelling direction of the collector 36, as necessary. In the case that a plurality of the spinnerets are used as described above, productivity can be enhanced by increasing the rotational speed of the collector 36.

An air injection device 38 is provided to each of the spinnerets 34, to spray air to the fiber strands 14 that are spun from the spinnerets 34, to thereby guide the fiber strands 14 to be collected toward the collector 36.

If a multi-hole spin pack having a number of holes is applied for mass production, mutual interference occurs between multiple holes, and thus fibers not collected while flying. As a result, since the porous nanoweb 10 that is obtained by using the multi-hole spin pack become too bulky, it may be difficult to form the porous nanoweb 10 and may act as a cause of the trouble of the spin.

Therefore, in the present embodiment to solve this problem, a multi-hole spin pack is used and an air injection device 38 is provided at each spinneret. Accordingly, when the fiber strands 14 are spun, air is injected so that the fiber strands 14 are well collected on the collector 36.

An air pressure of an air injection device of a multi-hole spin pack nozzle is set in the range of 0.1 to 0.6 Mpa. In this case, the air pressure that is less than 0.1 MPa does not contribute to a trapping/accumulation, and the air pressure that exceeds 0.6 Mpa hardens cone of the spin nozzle firmly to thus raise a phenomenon of blocking the needle thereby causing a spin trouble.

The collector 36 may be configured to employ a conveyor for transporting nanowebs such that the ultra-fine fiber strands 14 spun from the plurality of spinnerets 34 are sequentially accumulated on the conveyor.

A substrate roll 44 around which a porous substrate 20 is wound is provided in the front side of the collector 36 to supply the porous substrate 20 for the collector 36, and a pressing roller 40 is provided in the rear of the collector 36, in which the pressing roller 40 presses the nanoweb 10 fabricated by an electrospinning method to make the nanoweb 10 to a predetermined thickness. In addition, a nanoweb roll 42 is provided in which the porous nanoweb 10 pressed through the pressing roller 40 is wound on the nanoweb roll 42.

The process of manufacturing the waterproof sound-permitting sheet by using the electrospinning device will follow. When the collector 36 is driven, the porous substrate 20 is moved on the upper surface of the collector 36. That is, the porous substrate 20 wound on the substrate roll 44 is unrolled to then be supplied to the collector 36.

In addition, a high voltage electrostatic force is applied between the collector 36 and the spinnerets 34, and thus the polymer material to which the pigment is added is made into the ultra-fine fiber strands 14 to then be spun to the porous substrate. Then, the ultra-fine fiber strands 14 are accumulated on the porous substrate 20 to thus form a porous nanoweb 10 having a black or different color and having a plurality of pores 12.

Here, since air is sprayed on each of the spinnerets 34 from the air injection device 38, the spun fiber strands are not trapped in the collector 36 but are prevented from blowing.

In addition, while a composite sheet in which the porous nanoweb 10 is formed on the porous substrate 20 is made into a certain thickness while passing through the pressure roller 40, and is wound around the nanoweb roll 42.

Figure 4:
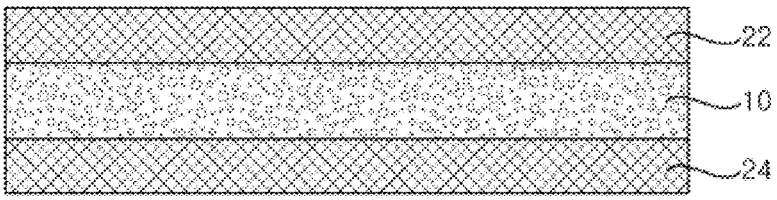
FIG. 4 is a cross-sectional view of a waterproof sound-permitting sheet according to a second embodiment of the present invention.

As shown in FIG. 4, a waterproof sound-permitting sheet according to a second embodiment of the present invention includes: a porous nanoweb 10 that has a plurality of pores and that is formed by electrospinning a polymer material to which a black or different color pigment is added; a first porous substrate 22 that has a plurality of pores and that is formed on one surface of the porous nanoweb 10; and a second porous substrate 24 that has a plurality of pores and that is formed on the other surface of the porous nanoweb 10.

The porous nanoweb 10 according to a second embodiment of the present invention has the same configuration as the porous nanoweb 10 according to the first embodiment of the present invention, and a configuration of the first porous substrate 22 and the second porous substrate 24 are the same as the configuration of the porous substrate 20 that is described in the first embodiment.

The waterproof sound-permitting sheet according to the second embodiment is formed into a three-layer structure where the first porous substrate 22 and the second porous substrate 24 are stacked on both side surfaces of the porous nanoweb 10, respectively, to thereby enhance the strength of the waterproof sound-permitting sheet.

Figure 5:
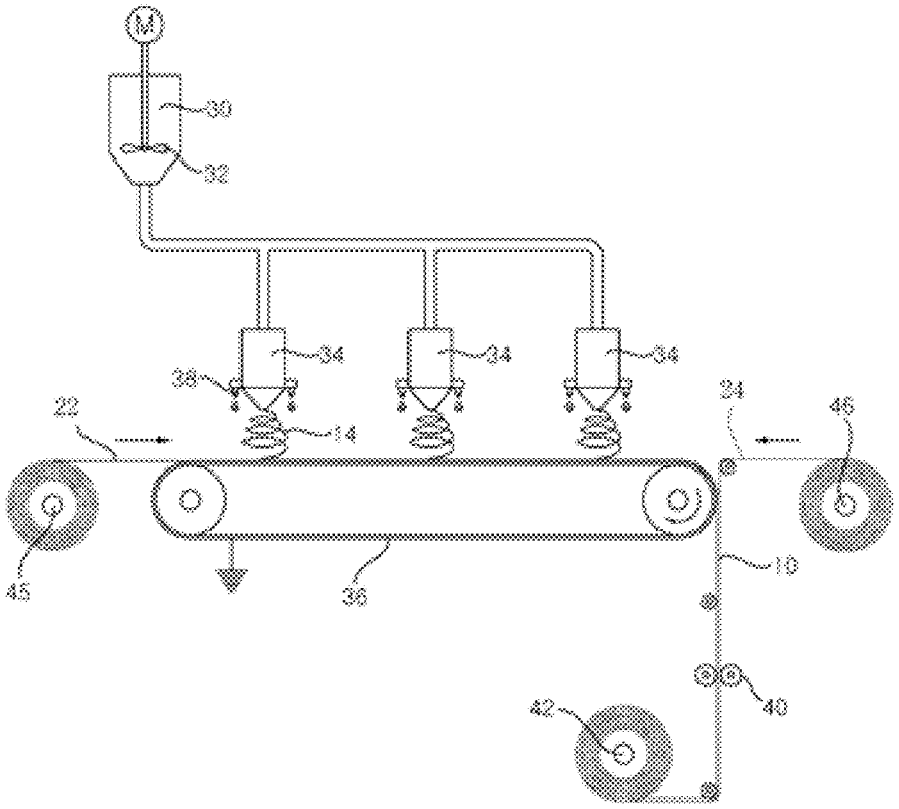
FIG. 5 is a configuration diagram of an electrospinning apparatus for producing a waterproof sound-permitting sheet according to the second embodiment of the present invention.

As shown in FIG. 5, an electrospinning apparatus for producing a waterproof sound-permitting sheet according to the second embodiment of the present invention includes: a spinning solution tank 30 that stores a spinning solution that is formed by mixing a polymer material to which s black or different color pigment is added with a solvent; a plurality of spinnerets 34 that are connected to a high voltage generator and connected to the spinning solution tank 30, to thus spin ultra-fine fiber strands 14; and a collector 36 on which the ultra-fine fiber strands 14 spun from the spinnerets 34 are accumulated to thereby produce a porous nanoweb 10.

The electrospinning apparatus according to the second embodiment is the same as the electrospinning apparatus described in the first embodiment, but a first substrate roll 45 around which a first porous substrate 22 is wound is arranged in front side of the collector 36, and a second substrate roll 46 around which a second porous substrate 24 is wound is arranged in the rear side of the collector 36.

The process of manufacturing the waterproof sound-permitting sheet by using the electrospinning device according to the second embodiment will follow. When the collector 36 is driven, the first porous substrate 22 is moved on the upper surface of the collector 36.

In addition, a high voltage electrostatic force is applied between the collector 36 and the spinnerets 34, and thus the polymer material to which the pigment is added is made into the ultra-fine fiber strands 14 to then be spun to the first porous substrate 22. Then, the ultra-fine fiber strands 14 are accumulated on the first porous substrate 22 to thus form a porous nanoweb 10 having a black or different color and having a plurality of pores 12.

Here, since air is sprayed on each of the spinnerets 34 from the air injection device 38, the spun fiber strands are not trapped in the collector 36 but are prevented from blowing.

Then, the second porous substrate 24 wound on the second substrate roll 46 disposed in the rear side of the collector 36 is supplied to the rear side of the collector 36, to thus make the second porous substrate 24 stacked on the other surface of the porous nanoweb 10.

In addition, the composite sheet of a laminated three-layer structure where the first porous substrate 22 and the second porous substrate 24 are stacked on both side surfaces of the porous nanoweb 10, respectively, is made into a certain thickness while passing through the pressure roller 40, and is wound around the nanoweb roll 42.

Figure 6:
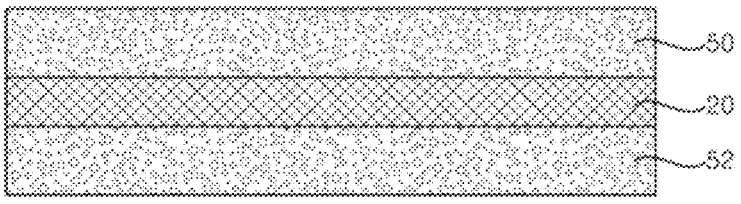
FIG. 6 is a cross-sectional view of a waterproof sound-permitting sheet according to a third embodiment of the present invention.

As shown in FIG. 6, a waterproof sound-permitting sheet according to a third embodiment of the present invention includes: a porous substrate 20 that has a plurality of pores; a first nanoweb layer 50 that is stacked on one surface of the porous substrate 20, that has a plurality of pores, and that is formed by electrospinning a polymer material to which a black or different color pigment is added; and a second nanoweb layer 52 that is stacked on the other surface of the porous substrate 20, that has a plurality of pores, and that is formed by electrospinning a polymer material to which a black or different color pigment is added.

The porous substrate 20 according to the third embodiment is the same as the porous substrate 10 described in the first embodiment, and the first nanoweb layer 50 and the second nanoweb layer 52 are the same as the porous nanoweb 10 described in the first embodiment.

The waterproof sound-permitting sheet according to the third embodiment is configured to have a three-layer structure where the first nanoweb layer 50 is stacked on one surface of the porous substrate 20 and the second nanoweb layer 52 is stacked on the other surface of the porous substrate 20.

Figure 7:
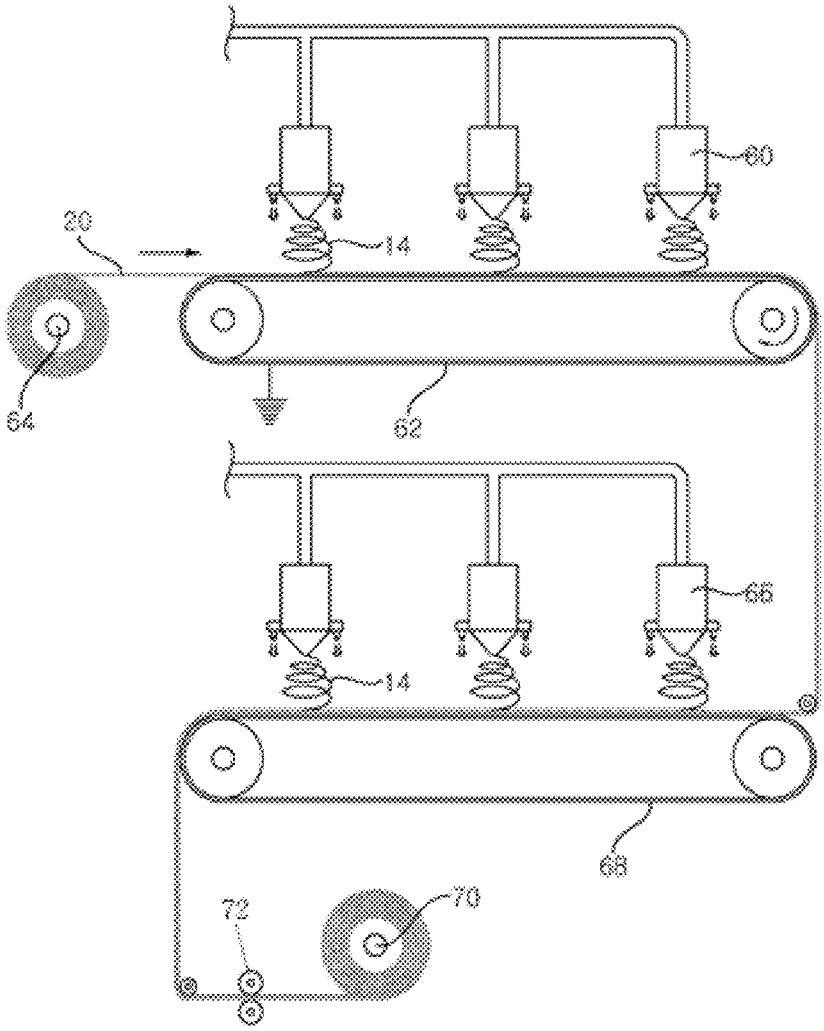
FIG. 7 is a configuration diagram of an electrospinning apparatus for producing a waterproof sound-permitting sheet according to the third embodiment of the present invention.

As shown in FIG. 7, an electrospinning apparatus for producing a waterproof sound-permitting sheet according to the third embodiment of the present invention includes: a plurality of first spinnerets 60 that spin a spinning solution that is formed by mixing a polymer material to which s black or different color pigment is added with a solvent, to thus form the first nanoweb layer 50; a first collector 62 on which ultra-fine fiber strands spun from the first spinnerets 60 are accumulated; a plurality of second spinnerets 66 that are disposed at the lower side of the first collector 62 and that spin a spinning solution that is formed by mixing a polymer material to which s black or different color pigment is added with a solvent, to thus form the second nanoweb layer 52; and a second collector 68 on which ultra-fine fiber strands spun from the second spinnerets 66 are accumulated.

Here, the first spinnerets 60 and the second spinnerets 66 are connected to a spinning solution tank (not shown) that contains a spinning solution that is formed by mixing a polymer material to which s black or different color pigment is added with a solvent.

A substrate roll 64 around which a porous substrate 20 is wound is provided in the front side of a first collector 62 to thus supply the porous substrate for the first collector 62, and a pressing roller 72 is provided in the rear side of a second collector 68 in which the pressing roller 72 presses the sheet of the three-layer structure prepared by the electrospinning method to then be made into a predetermined thickness while passing through the pressing roller 72 and to then be wound on a sheet roll 70.

The process of manufacturing the waterproof sound-permitting sheet by using the electrospinning device according to the third embodiment will follow. When the first collector 62 is driven, the porous substrate 20 is moved on the upper surface of the first collector 62.

In addition, a high voltage electrostatic force is applied between the first collector 62 and the first spinnerets 60, and thus the polymer material to which the pigment is added is made into the ultra-fine fiber strands 14 in the first spinnerets 60, to then be spun to one surface of the porous substrate 20. Then, the ultra-fine fiber strands 14 are accumulated on one surface of the porous substrate 20 to thus form a first nanoweb layer 50 having a black or different color and having a plurality of pores 12.

Then, the porous substrate on which the first nanoweb layer 50 is formed is guided to the second collector 68. Here, the other surface of the porous substrate is disposed facing up. Then, a high voltage electrostatic force is applied between the second collector 68 and the second spinnerets 66, and thus the polymer material to which the pigment is added is made into the ultra-fine fiber strands 14 in the second spinnerets 66, to then be spun to the other surface of the porous substrate 20. Then, the ultra-fine fiber strands 14 are accumulated on the other surface of the porous substrate 20 to thus form a second nanoweb layer 52 having a black or different color and having a plurality of pores 12.

In addition, while a composite sheet in which the nanoweb layers are formed on both surfaces of the porous substrate is made into a certain thickness while passing through the pressure roller 72, and is wound around the sheet roll 70.

Figure 8:
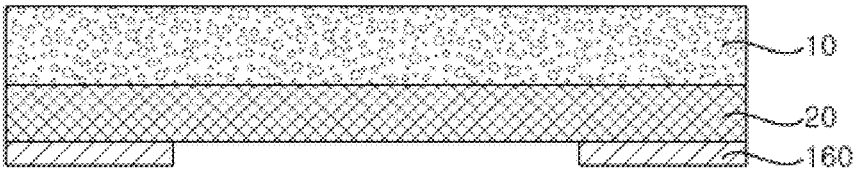
FIG. 8 is a cross-sectional view of a waterproof sound-permitting sheet according to a fourth embodiment of the present invention.

As illustrated in FIG. 8, a waterproof sound-permitting sheet according to a fourth embodiment of the present invention, includes: a porous substrate 20 having a plurality of pores; a porous nanoweb 10 that is formed on one surface of the porous substrate, that has a plurality of pores, and that is formed by electrospinning a polymer material to which a black or different color pigment is added; and a double-sided adhesive tape 160 that is formed on one surface of the porous substrate 20 or the porous nanoweb 10.

Since the structure of the porous substrate 20 and the porous nanoweb 10 is the same as that of the porous nanoweb 10 described in the first embodiment, the detailed description thereof will be omitted.

The double-sided adhesive tape 160 is formed along the edge of the porous nanoweb 10 or the porous substrate 20 and serves to attach the waterproof sound-permitting sheet on a portion of the sound holes of an electronic device. Here, the double-sided adhesive tape 160 may be configured to employ a non-substrate type or a substrate type, a conventional double-sided adhesive tape, or a double-sided adhesive tape that is formed by an electrospinning method.

Figure 9:
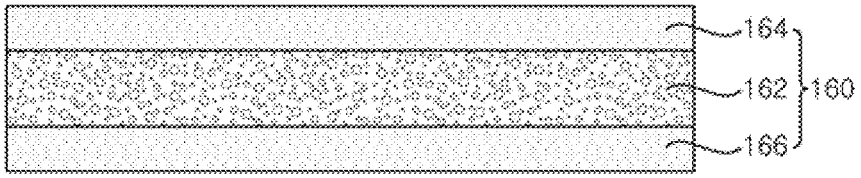
FIG. 9 is a cross-sectional view of a double-sided adhesive tape applied to a waterproof sound-permitting sheet of the present invention.

As shown in FIG. 9, the double-sided adhesive tape 160 which is formed by the electrospinning method includes: a substrate 162 that is formed into a nanoweb type having a plurality of pores by an electrospinning method; a first adhesive layer 164 that is formed into a nanoweb type by spinning an adhesive material on one surface of the substrate 162; and a second adhesive layer 166 that is formed into a nanoweb type by spinning the adhesive material on the other surface of the substrate 162.

Here, the substrate 162 is formed into a nanoweb type having a plurality of pores, in which a polymer material is made into ultra-fine fiber strands by an electrospinning method, and the ultra-fine fiber strands are accumulated on the substrate 162.

Then, the first adhesive layer 164 and the second adhesive layer 166 are formed by spinning the adhesive material on one surface and the other surface of the substrate 162, respectively. Here, the adhesive material is introduced into the pores of the substrate 162, to thus increase the amount of the adhesive in the pores. Thus, even if the double-sided adhesive tape 160 has the same thickness as the conventional double-sided adhesive tape, the amount of the adhesive is more than the conventional double-sided adhesive tape to thereby increase the adhesive force.

The double-sided adhesive tape 160 can be integrally formed in the electrospinning apparatus for forming the porous nanoweb 10, or can be prepared separately from another electrospinning apparatus to then be laminated on the other surface of the porous nanoweb.

Figure 10:
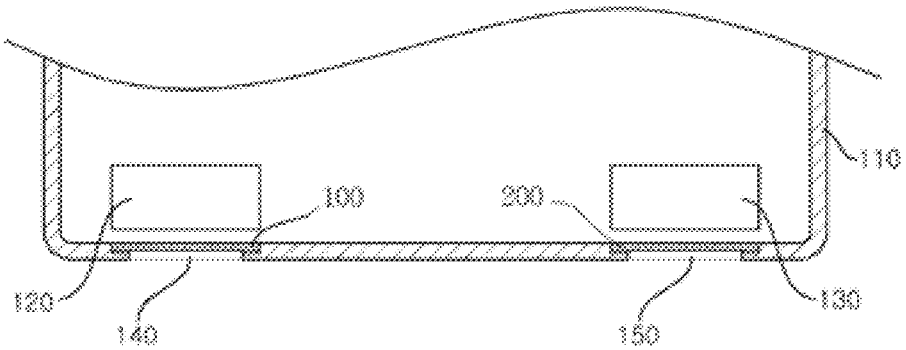
FIG. 10 is a partial sectional view of an electronic device to which a waterproof sound-permitting sheet according to the present invention is applied.
Figure 11:
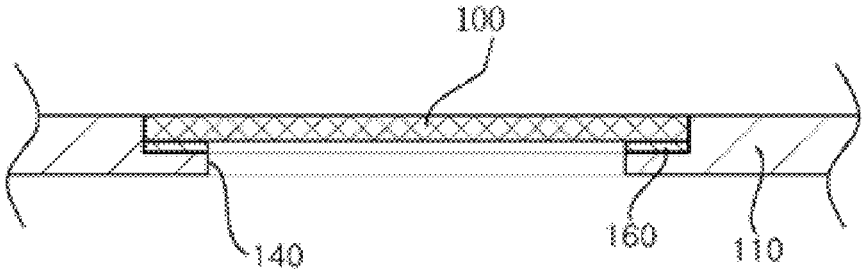
FIG. 11 is an enlarged view of essential elements of FIG. 10.

FIG. 10 is a partial sectional view of an electronic device to which a waterproof sound-permitting sheet according to the present invention is applied. FIG. 11 is an enlarged view of essential elements of FIG. 10.

The electronic device according to the present invention includes: a main body 110; a speaker 120 that is provided in the main body 110, and through which a sound is discharged to the outside from the main body 110; and a microphone 130 that is provided in the main body 110, and through which the sound is input to the main body 110, wherein sound holes 140 and 150 through which the sound passes are formed at portions where the speaker 120 and the microphone 130 are mounted in the main body 110.

Then, the waterproof sound-permitting sheets 100 and 200 according to the invention are provided on the sound holes 140 and 150, to thus block water or dust and pass the sound. Here, the waterproof sound-permitting sheets 100 and 200 may employ the waterproof sound-permitting sheets explained in the first to fourth embodiments described above. A ring-shaped double-sided adhesive tape 160 is mounted on the inner surface of the sound holes 140 and 150 to thus secure the waterproof sound-permitting sheets 100 and 200 on the inner surfaces of the sound holes 140 and 150.

The waterproof sound-permitting sheet according to the present embodiment, is installed on air vent holes through which the heat of the electronic device or air is passed, in addition to the sound holes 140 and 150, and serves to pass air or heat but block water or dust.

As described above, the present invention has been described with respect to particularly preferred embodiments. However, the present invention is not limited to the above embodiments, and it is possible for one who has an ordinary skill in the art to make various modifications and variations, without departing off the spirit of the present invention. Thus, the protective scope of the present invention is not defined within the detailed description thereof but is defined by the claims to be described later and the technical spirit of the present invention.

The waterproof sound-permitting sheet according to the present invention is mounted in an electronic device to pass air or heat but block water or dust. The waterproof sound-permitting sheet according to the present invention is applied for the electronic device such as a mobile terminal that is carried and used to perform a water resistance function. In addition, the waterproof sound-permitting sheet according to the present invention is formed into a nanoweb type having a plurality of pores to be formed by an electrospinning method to thereby improve the waterproof performance and sound-permitting performance.

What is claimed is:

1. A waterproof sound-permitting sheet comprising:

a porous substrate layer having a plurality of first pores;

a porous nanoweb layer, which is stacked on a first surface of the porous substrate layer, has a plurality of second pores, and is formed by electrospinning a polymer material to which a color pigment is added, and the porous nanoweb layer is formed of accumulation of ultra-fine fiber strands having a diameter in a range of 0.3-1.5 urn by electrospinning the polymer material and the first pores have an average size of 2 um or less; and a double-sided adhesive tape which is stacked along an edge of the porous nanoweb layer on a second surface opposite to the first surface of the porous substrate layer, wherein the double-sided adhesive tape comprises: a substrate layer formed in a nanoweb layer form and having a plurality of third pores, a first adhesive layer formed on a first surface of the substrate layer, the first adhesive layer being formed in a first nanoweb form made of first nanofiber strands, the first nanofiber strands being made of a first adhesive material; and a second adhesive layer formed on a second surface opposite to the first surface of the substrate layer, the second adhesive layer formed in a second nanoweb form made of second nanofiber strands, the second nanofiber strands being made of a second adhesive material.

2. The waterproof sound-permitting sheet according to claim 1, wherein the porous substrate layer is formed of any one selected from the group consisting of a thermal bond nonwoven fabric, a spun bond nonwoven fabric, a chemical bond nonwoven fabric, an air-laid nonwoven fabric, a cloth, styrofoam, paper, and a mesh.

3. The waterproof sound-permitting sheet according to claim 1, wherein a color pigment is coated on the porous substrate layer.

4. The waterproof sound-permitting sheet according to claim 1, wherein the polymer material includes any one selected from the group consisting of PAN, polyvinylidene fluoride (PVdF), polyester sulfone (PES), and polystyrene (PS), or a mixture of polyvinylidene fluoride (PVdF) and polyacrylonitrile (PAN), or a mixture of PVdF and PES, or a mixture of PVdF and thermoplastic polyurethane (TPU).

5. The waterproof sound-permitting sheet according to claim 1, wherein the porous substrate layer comprises: a first porous substrate that is stacked on a first surface of the porous nanoweb layer; and a second porous substrate that is stacked on a second surface opposite to the first surface of the porous nanoweb.

6. The waterproof sound-permitting sheet according to claim 1, wherein the porous nanoweb layer comprises: a first nanoweb layer that is stacked on the first surface of the porous substrate layer; and a second nanoweb layer that is stacked on the second surface of the porous substrate layer.

7. An electronic device comprising:

a body in which an air vent hole is formed in order to discharge heat or air generated inside of the electronic device; and a waterproof sound-permitting sheet according to claim 1 disposed on the air vent hole.

* * * * *